US009799943B2

(12) United States Patent
Konanur et al.

(10) Patent No.: US 9,799,943 B2
(45) Date of Patent: Oct. 24, 2017

(54) CABLE ANTENNA APPARATUS AND SYSTEM

(75) Inventors: Anand S. Konanur, San Jose, CA (US); Ulun Karacaoglu, San Diego, CA (US); Songnan Yang, San Jose, CA (US); Xintian E. Lin, Palo Alto, CA (US)

(73) Assignee: INTEL CORPORATION, Santa Clara, CA (US)

( * ) Notice: Subject to any disclaimer, the term of this patent is extended or adjusted under 35 U.S.C. 154(b) by 800 days.

(21) Appl. No.: 12/957,208

(22) Filed: Nov. 30, 2010

(65) Prior Publication Data

US 2012/0133565 A1 May 31, 2012

(51) Int. Cl.
*H01Q 1/22* (2006.01)
*H01Q 13/20* (2006.01)

(52) U.S. Cl.
CPC ..... *H01Q 1/2266* (2013.01); *H01Q 13/203* (2013.01)

(58) Field of Classification Search
CPC ..... H01C 13/203; H01C 1/2266
USPC ..... 343/702, 790–792, 771
See application file for complete search history.

(56) References Cited

U.S. PATENT DOCUMENTS

| | | | | |
|---|---|---|---|---|
| 2,704,811 | A * | 3/1955 | Walters | 343/710 |
| 4,509,056 | A * | 4/1985 | Ploussios | 343/791 |
| 4,719,471 | A * | 1/1988 | Killingsworth | 343/792 |
| 4,940,989 | A * | 7/1990 | Austin | 343/749 |
| 5,138,328 | A * | 8/1992 | Zibrik et al. | 343/702 |
| 5,252,984 | A * | 10/1993 | Dorrie et al. | 343/791 |
| 5,373,300 | A * | 12/1994 | Jenness et al. | 343/702 |
| 5,684,672 | A * | 11/1997 | Karidis et al. | 361/679.26 |
| 6,339,400 | B1 * | 1/2002 | Flint et al. | 343/702 |
| 6,531,985 | B1 * | 3/2003 | Jones et al. | 343/702 |
| 6,853,336 | B2 * | 2/2005 | Asano et al. | 343/702 |
| 7,236,139 | B2 * | 6/2007 | Waschenko | 343/790 |
| 8,860,620 | B2 * | 10/2014 | Kitano | H01Q 11/08 343/790 |
| 2008/0081576 | A1 * | 4/2008 | Olsen | H01Q 13/203 455/187.1 |

* cited by examiner

*Primary Examiner* — Howard Williams

(57) ABSTRACT

Embodiments of an apparatus and system are described for a coaxial antenna. An apparatus may comprise, for example, an integrated circuit and a coaxial cable coupled to the integrated circuit and arranged to operate as an antenna, the coaxial cable comprising an inner conductor layer and at least one insulator layer, wherein one or more portions of the inner conductor layer are exposed to allow the exposed inner conductor layer to operate as a radiating element for the antenna. Other embodiments are described and claimed.

11 Claims, 4 Drawing Sheets

CABLE ANTENNA APPARATUS AND SYSTEM

BACKGROUND

The performance and capabilities of modern computing systems have increased rapidly in recent years. One particular area in which capabilities have evolved is wireless connectivity. Many computing system today include wireless connectivity components. The number and cost of capabilities and components in modern computing systems continues to increase as computing systems continue to decrease in size. As the available space for components continues to decrease, a reduction in the space occupied by wireless connectivity components becomes an important consideration. As a result, it is desirable to adapt wireless connectivity components, such as antennas, to occupy less space in a mobile computing device. Consequently, there exists a substantial need for techniques to implement a cable antenna system and apparatus in a mobile computing device.

DETAILED DESCRIPTION

The embodiments are generally directed to techniques designed to reduce the size and cost of a wireless antenna in a mobile computing device. Various embodiments provide a system and apparatus that include a cable coupled to an integrated circuit and arranged to operate as an antenna for a mobile computing device. In various embodiments, the cable may comprise a coaxial cable having an inner conductor layer and at least one insulator layer, wherein one or more portions of the inner conductor layer is exposed to allow the exposed inner conductor layer to operate as a radiating element for the antenna. Other embodiments are described and claimed.

With the progression over time toward the use of mobile computing devices of decreasing size and cost, the space available for antennas in a mobile computing device platform is becoming increasingly limited. Modern mobile computing devices, such as wide screen notebook computers, thin and ultra-thin notebook computers, netbook computers, tablet computers and other mobile computing devices, require low cost components that provide effective functionality. Presently, many mobile computing devices included discrete antenna elements coupled to one or more wireless communication modules using coaxial cables. These discrete antenna elements are often costly and generally consume a relatively large amount of space inside a mobile computing device enclosure. By eliminating the need for a discrete antenna element in a mobile computing device, the cost of the device may be reduced and the space required for implementation of an antenna may also be reduced.

Embodiments may include one or more elements. An element may comprise any structure arranged to perform certain operations. Each element may be implemented as hardware, software, or any combination thereof, as desired for a given set of design parameters or performance constraints. Although embodiments may be described with particular elements in certain arrangements by way of example, embodiments may include other combinations of elements in alternate arrangements.

It is worthy to note that any reference to "one embodiment" or "an embodiment" means that a particular feature, structure, or characteristic described in connection with the embodiment is included in at least one embodiment. The appearances of the phrases "in one embodiment" and "in an embodiment" in various places in the specification are not necessarily all referring to the same embodiment.

Figure 1:
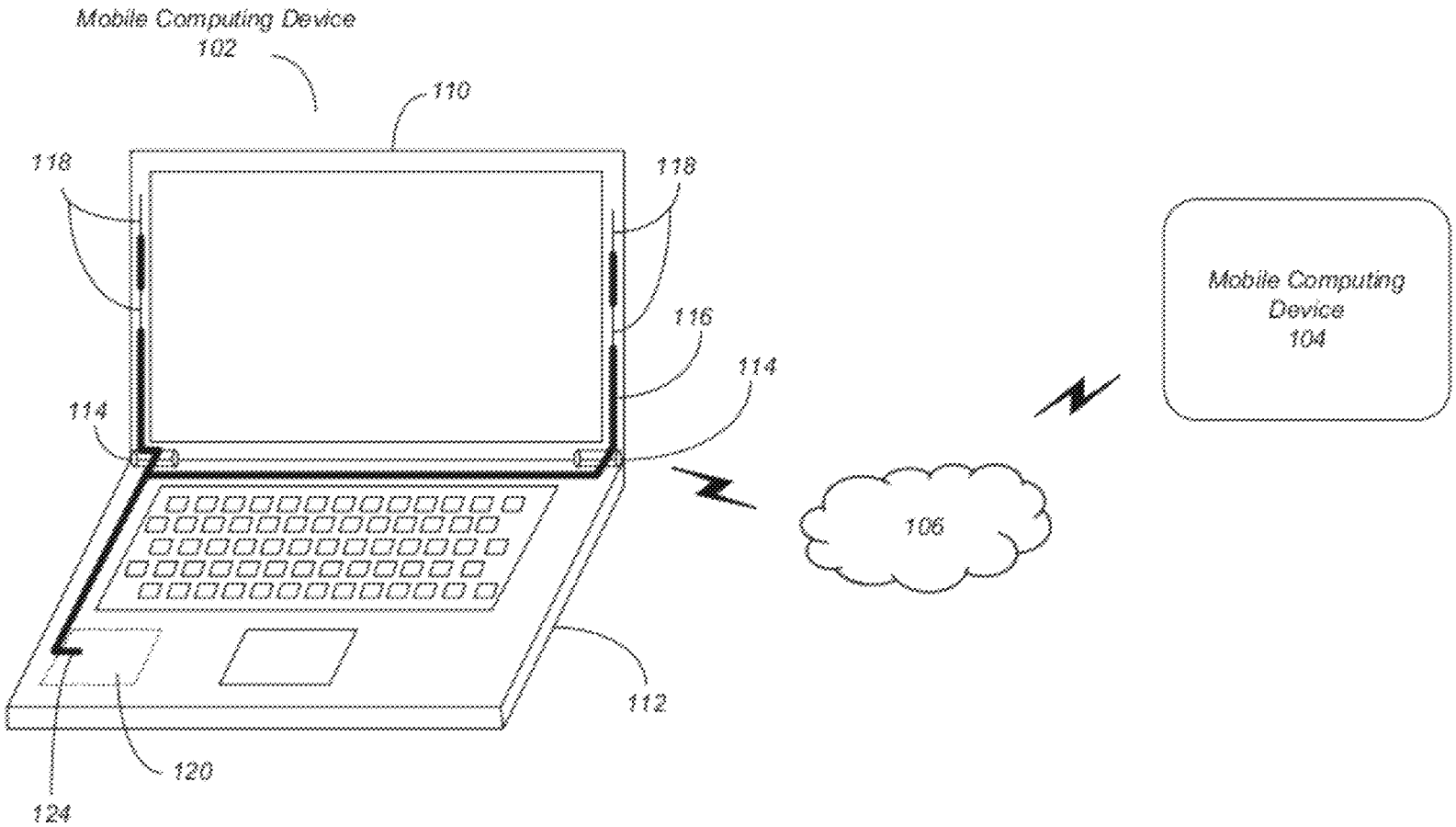
FIG. 1 illustrates one embodiment of a first system.

FIG. 1 illustrates a block diagram of one embodiment of a communications system 100. In various embodiments, the communications system 100 may comprise multiple nodes. A node generally may comprise any physical or logical entity for communicating information in the communications system 100 and may be implemented as hardware, software, or any combination thereof, as desired for a given set of design parameters or performance constraints. Although FIG. 1 may show a limited number of nodes by way of example, it can be appreciated that more or less nodes may be employed for a given implementation.

In various embodiments, the communications system 100 may comprise, or form part of a wired communications system, a wireless communications system, or a combination of both. For example, the communications system 100 may include one or more nodes arranged to communicate information over one or more types of wired communication links. Examples of a wired communication link may include, without limitation, a wire, cable, bus, printed circuit board (PCB), Ethernet connection, peer-to-peer (P2P) connection, backplane, switch fabric, semiconductor material, twisted-pair wire, co-axial cable, fiber optic connection, and so forth. The communications system 100 also may include one or more nodes arranged to communicate information over one or more types of wireless communication links. Examples of a wireless communication link may include, without limitation, a radio channel, infrared channel, radio-frequency (RF) channel, Wireless Fidelity (WiFi) channel, a portion of the RF spectrum, and/or one or more licensed or license-free frequency bands.

The communications system 100 may communicate information in accordance with one or more standards as promulgated by a standards organization. In one embodiment, for example, various devices comprising part of the communications system 100 may be arranged to operate in accordance with one or more of the IEEE 802.11 standard, the WiGig Alliance™ specifications, WirelessHD™ specifications, standards or variants, such as the WirelessHD Specification, Revision 1.0d7, Dec. 1, 2007, and its progeny as promulgated by WirelessHD, LLC (collectively referred to as the "WirelessHD Specification"), or with any other wireless standards as promulgated by other standards organizations such as the International Telecommunications Union (ITU), the International Organization for Standardization (ISO), the International Electrotechnical Commission (IEC), the Institute of Electrical and Electronics Engineers (information IEEE), the Internet Engineering Task Force (IETF), and so forth. In various embodiments, for example, the communications system 100 may communicate information according to one or more IEEE 802.11 standards for wireless local area networks (WLANs) such as the information IEEE 802.11 standard (1999 Edition, Information Technology Telecommunications and Information Exchange Between Systems—Local and Metropolitan Area Networks—Specific Requirements, Part 11: WLAN Medium Access Control (MAC) and Physical (PHY) Layer Specifications), its progeny and supplements thereto (e.g., 802.11a, b, g/h, j, n, VHT SG, and variants); IEEE 802.15.3 and variants; IEEE 802.16 standards for WMAN including the IEEE 802.16 standard such as 802.16-2004, 802.16.2-2004, 802.16e-2005, 802.16f, and variants; WGA (WiGig) progeny and variants; European Computer Manufacturers Association (ECMA) TG20 progeny and variants; and other wireless networking standards. The embodiments are not limited in this context.

The communications system 100 may communicate, manage, or process information in accordance with one or more protocols. A protocol may comprise a set of predefined rules or instructions for managing communication among nodes. In various embodiments, for example, the communications system 100 may employ one or more protocols such as a beam forming protocol, medium access control (MAC) protocol, Physical Layer Convergence Protocol (PLCP), Simple Network Management Protocol (SNMP), Asynchronous Transfer Mode (ATM) protocol, Frame Relay protocol, Systems Network Architecture (SNA) protocol, Transport Control Protocol (TCP), Internet Protocol (IP), TCP/IP, X.25, Hypertext Transfer Protocol (HTTP), User Datagram Protocol (UDP), a contention-based period (CBP) protocol, a distributed contention-based period (CBP) protocol and so forth. In various embodiments, the communications system 100 also may be arranged to operate in accordance with standards and/or protocols for media processing. The embodiments are not limited in this context.

As shown in FIG. 1, the communications system 100 may comprise a network 106 and a plurality of nodes including mobile computing device 102 and mobile computing device 104. In various embodiments, the nodes 102 and 104 may be implemented as various types of wireless or mobile computing devices. Examples of wireless devices may include, without limitation, an IEEE 802.15.3 piconet controller (PNC), a controller, an IEEE 802.11 PCP, a coordinator, a station, a subscriber station, a base station, a wireless access point (AP), a wireless client device, a wireless station (STA), a laptop computer, ultra-laptop computer, portable computer, personal computer (PC), notebook PC, tablet computer, handheld computer, personal digital assistant (PDA), cellular telephone, combination cellular telephone/PDA, smartphone, pager, messaging device, media player, digital music player, set-top box (STB), appliance, workstation, user terminal, mobile unit, consumer electronics, television, digital television, high-definition television, television receiver, high-definition television receiver, and so forth.

In some embodiments, the nodes 102 and 104 may comprise one more wireless interfaces and/or components for wireless communication such as one or more transmitters, receivers, transceivers, chipsets, amplifiers, filters, control logic, network interface cards (NICs), antennas, antenna arrays, modules and so forth. Examples of conventional antennas may include, without limitation, an internal antenna, an omni-directional antenna, a monopole antenna, a dipole antenna, an end fed antenna, a circularly polarized antenna, a micro-strip antenna, a diversity antenna, a dual antenna, an antenna array, and so forth. These types of discrete antenna elements may be costly and may consume a relatively large amount of space in the area of the node 102 or 104 allocated for the antenna.

In various embodiments, the nodes 102 and 104 may comprise or form part of a wireless network 106. In some embodiments, for example, the wireless network 106 may comprise or be implemented as various types of wireless networks and associated protocols suitable for a WPAN, a Wireless Local Area Network (WLAN), a Wireless Metropolitan Area Network, a Wireless Wide Area Network (WWAN), a Broadband Wireless Access (BWA) network, a radio network, a television network, a satellite network such as a direct broadcast satellite (DBS) network, a long term evolution (LTE) network and/or any other wireless communications network configured to operate in accordance with the described embodiments.

While the embodiments are not limited in this context, mobile computing device 102 illustrates one possible node in some embodiments. In various embodiments, mobile computing device 102 may include a display 110, a body 112, one or more hinges 114, a coaxial cable 116 and one or more integrated circuits 120. While a limited number and arrangement of components are shown in FIG. 1 for purposes of illustration, it should be understood that nodes 102 and 104 may include any number or arrangement of components and still fall within the described embodiments. For example, nodes 102 and 104 may additionally include, in some embodiments, memory containing instructions to be executed by one or more multi-core processors for example. The embodiments, however, are not limited to the elements or the configuration shown in this figure. Additional components for mobile computing devices 102 and 104 are discussed in further detail below with reference to FIG. 4.

In some embodiments, display 110 may comprise any suitable visual interface for displaying content to a user of the mobile computing device 102. In one embodiment, for example, the display 110 may be implemented by a liquid crystal display (LCD) or a touch-sensitive color LCD screen. The touch-sensitive LCD may be used with a stylus and/or a handwriting recognizer program in some embodiments. In various embodiments, the digital display includes a protective housing that surrounds the digital display and is coupled to body 112 using hinges 114.

Hinges 114 may comprise any suitable connection means for attaching display 110 to body 112. Body 112 may comprise, in various embodiments, an enclosure for securing or enclosing a plurality of integrated circuits such as integrated circuit 120 and any other number of components for mobile computing device 102, such as a keyboard or trackpad. While mobile computing device 102 is illustrated as having a separate display 110 and body 112, it should be understood that the body 112 and the display 110 may be arranged in the same enclosure in some embodiments. For example, mobile computing device 102 may comprise a tablet computing device in some embodiments. The embodiments, however, are not limited in this context.

Integrated circuit 120 may comprise any suitable electric device, semiconductor device or other component in some embodiments. For example, integrated circuit 120 may comprise a multi-core processor in various embodiments. In some embodiments, integrated circuit 120 may include or comprise one or more radio modules or combination transmitter/receiver (e.g. transceiver) devices. In various embodiments, the transceiver device may comprise a device that has both a transmitter and a receiver that are combined and share common circuitry or a single housing. For example, in some embodiments, the transceiver may be operative to enable wireless communication capabilities for mobile computing device 102. Other embodiments are described and claimed.

In various embodiments, mobile computing device 102 may include cable 116. In some embodiments, cable 116 may comprise a coaxial cable. In various embodiments, coaxial cable 116 may be configured to operate as an antenna for mobile computing device 102. For example, rather than including a costly and space consuming discrete antenna element, mobile computing device 102 may utilize coaxial cable 116 as an antenna for wireless communication. In some embodiments, one or more portions of an inner conductor 118 of coaxial cable 116 may be exposed to allow the exposed inner conductor layer 118 to operate as a radiating element of cable antenna 116 for mobile computing device 102. While a coaxial cable is described hereinafter for purposes of illustration, it should be understood that the embodiments are not limited in this context. In various embodiments, any suitable cable could be used and still fall within the described embodiments.

FIG. 2 illustrates one embodiment of an apparatus 200. In some embodiments, apparatus 200 may comprise a section of coaxial cable 200 that may be the same or similar to coaxial cable 116 of FIG. 1. Coaxial cable 200 may comprise an electrical cable having an inner conductor layer 202 surrounded by a inner or dielectric insulating layer 204, surrounded by an outer conductor layer or shield 206 all of which is optionally surrounded by an outer insulator layer 208. Other embodiments are described and claimed.

In various embodiments, the characteristics of coaxial cable 200 may affect the physical size, frequency performance, attenuation, power handling capabilities, flexibility, strength and cost of the cable antenna system. For example, the inner conductor 202 might be solid or stranded as stranded is more flexible. To enhance high-frequency performance, in some embodiments, the inner conductor 202 may be silver-plated or copper-plated iron wire may be used as an inner conductor 202.

The inner insulator or dielectric layer 204 surrounding the inner conductor 202 may comprise solid plastic, a foam plastic, or may comprise air with spacers supporting the inner conductor 202. In various embodiments, the inner conductor 204 may comprise a solid polyethylene (PE) insulator or solid Teflon (PTFE). The embodiments are not limited in this context. Many conventional coaxial cables use braided copper wire forming the shield or outer conductor 208. In some embodiments, the outer conductor 208 may comprise multiple layers of braided conductive material or may comprise a thin foil shield covered by a wire braid. In some embodiments, the outer insulator layer 208 may comprise any suitable insulating material. For example, the outer insulator layer may comprise PVC, plastic, rubber or any other suitable material. Other embodiments are described and claimed.

In conventional implementations, to prevent the coaxial cable from acting as an antenna and to carry the high frequency signals to a discrete antenna element, the inner conductor 202 is enclosed by the inner insulator layer 204, the outer conductor layer 206 and optionally by the outer insulator layer 208. This may confine the radio waves from the inner conductor 202 to the space inside the tube created by the other coaxial cable components. In various embodiments, however, it may be advantageous to expose the inner conductor to allow the exposed portion of the coaxial cable to act as a radiating element or antenna, which may allow for the removal of any discrete antenna elements from a mobile computing device.

Figure 2C:
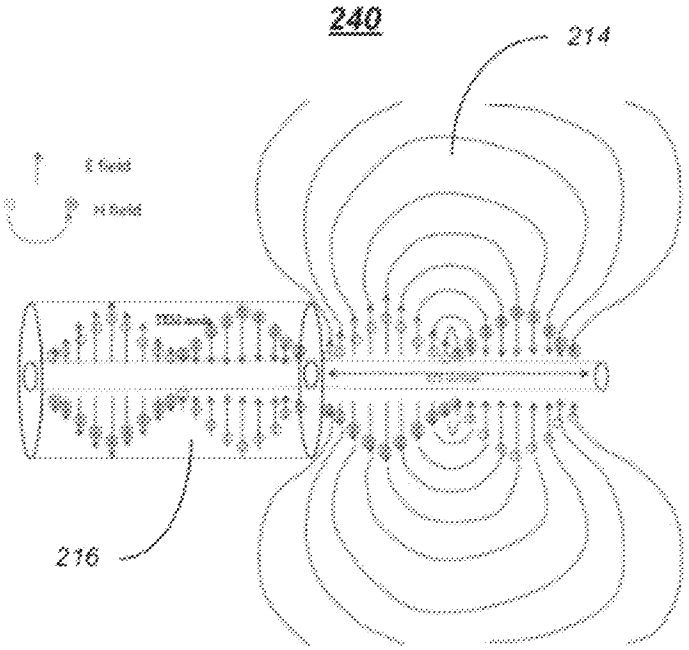
FIG. 2C illustrates one embodiment of a third apparatus.
Figure 2A:
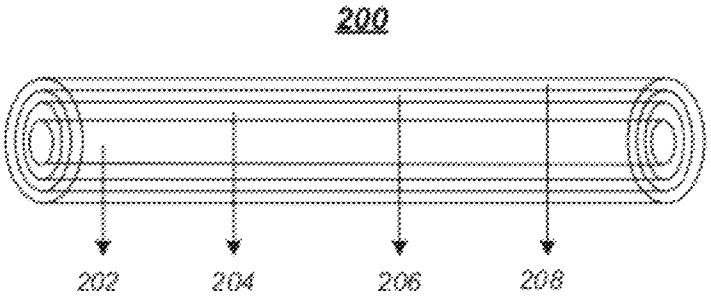
FIG. 2A illustrates one embodiment of a first apparatus.
Figure 2B:
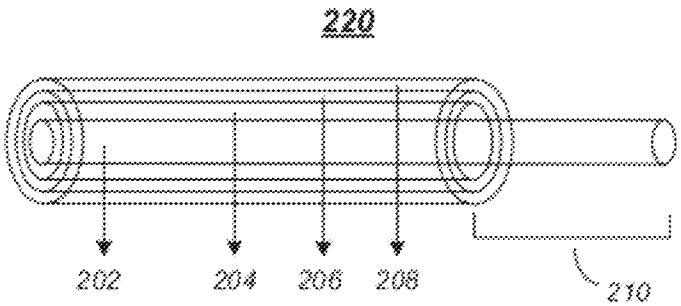
FIG. 2B illustrates one embodiment of a second apparatus.

FIG. 2B illustrates an apparatus 220 that may comprise a section of coaxial cable 220 that may be the same or similar to coaxial cable 116 of FIG. 1 or coaxial cable 200 of FIG. 2A. In various embodiments, coaxial cable 220 may additionally include a portion 210 of exposed inner conductor 202. In some embodiments, the dielectric insulator layer 204 and the outer insulator layer 208 may be removed in the area of the exposed inner conductor layer 210 allowing radiation from the inner conductor layer to escape. As shown in FIG. 2C, for example, electromagnetic field 216 may be confined within coaxial cable 240 in the areas where the insulator layers 204 and 206 remain, while the electromagnetic field 214 may allowed to escape in areas where the insulator layers 204 and 206 have been removed. While not shown in FIGS. 2A, 2B and 2C, the outer conductor layer 206 may optionally be removed or not removed and still fall within the described embodiments.

In various embodiments, a length of the exposed inner conductor layer 220 may be selected to correspond to approximately one half of one wavelength for a desired frequency of operation for the antenna. In some embodiments, the coaxial cable 116, 200, 220 or 240 may comprise two or more non-contiguous portions 118 of exposed inner conductor layer. For example, in some embodiments, a length of the exposed inner conductor layers 118, 210 and a length between each of the two- or more non-contiguous portions of exposed inner conductor layer 188, 210 may be selected to correspond to a desired resonant frequency for multiband operation of the cable antenna. Other embodiments are described and claimed.

In some embodiments, the length of each of the non-contiguous portions of exposed inner conductor layer may be the same or substantially similar. In other embodiments, the lengths may differ to allow for the implementation of different operating frequencies. In various embodiments, a length of the one or more portions of exposed inner conductor layer may be selected to allow a system or mobile computing device to send and receive information using one or more of a wireless local area network (WLAN), a wireless metropolitan area network (WMAN) or a long term evolution (LTE) network. For example, a length of the exposed inner conductor layer may comprise approximately 60 mm corresponding to a frequency of approximately 2400-2485 MHz for WLAN operation or approximately 214 mm corresponding to a frequency of approximately 700 MHz for LTE operation. The embodiments are not limited in this respect.

Returning to FIG. 1, coaxial cable 116 may be configured to pass through the one or more hinges 114 arranged to couple the digital display 110 to device body 112 in some embodiments. In various embodiments, a first end of the coaxial cable 124 may be coupled to the integrated circuit 120 using coaxial connectors on the first end of the coaxial cable 124 and the integrated circuit 120. The coaxial cable 116 may be arranged to pass through the one or more hinges 114 into a cavity created by the perimeter edges of the digital display 110 in some embodiments. For example, in some embodiments, the coaxial cable may be located in a bezel around the perimeter of digital display 110. In some embodiments, coaxial cable 116 may be secured inside digital display 110 using any suitable connection means including, but not limited to, mechanical spacers or clips. For example, clips could be used to secure coaxial cable 116 within digital display 110 to ensure that the exposed portions 118 of coaxial cable 116 do not come in contact with any metal within display 110, which may disrupt the performance capabilities of coaxial cable 116. The embodiments are not limited in this context.

In various embodiments, the second end coaxial cable 116 opposite the first end 124 may terminate or be capped in an open space within display 110. For example, rather than being attached to a large and costly discrete antenna element, coaxial cable 116 may simple be capped or otherwise electrically sealed at its second end. As shown in FIG. 1, mobile computing device 102 may optionally include two or more coaxial cables 116 on either side of display 110 in some embodiments. In various embodiments, the separate coaxial cables may be commonly connected to integrated circuit 120 or may each include their own connection to integrated circuit 120. In some embodiments, each separate coaxial cable may be configured to operate as an antenna using a different frequency. Other embodiments are described and claimed.

Figure 3:
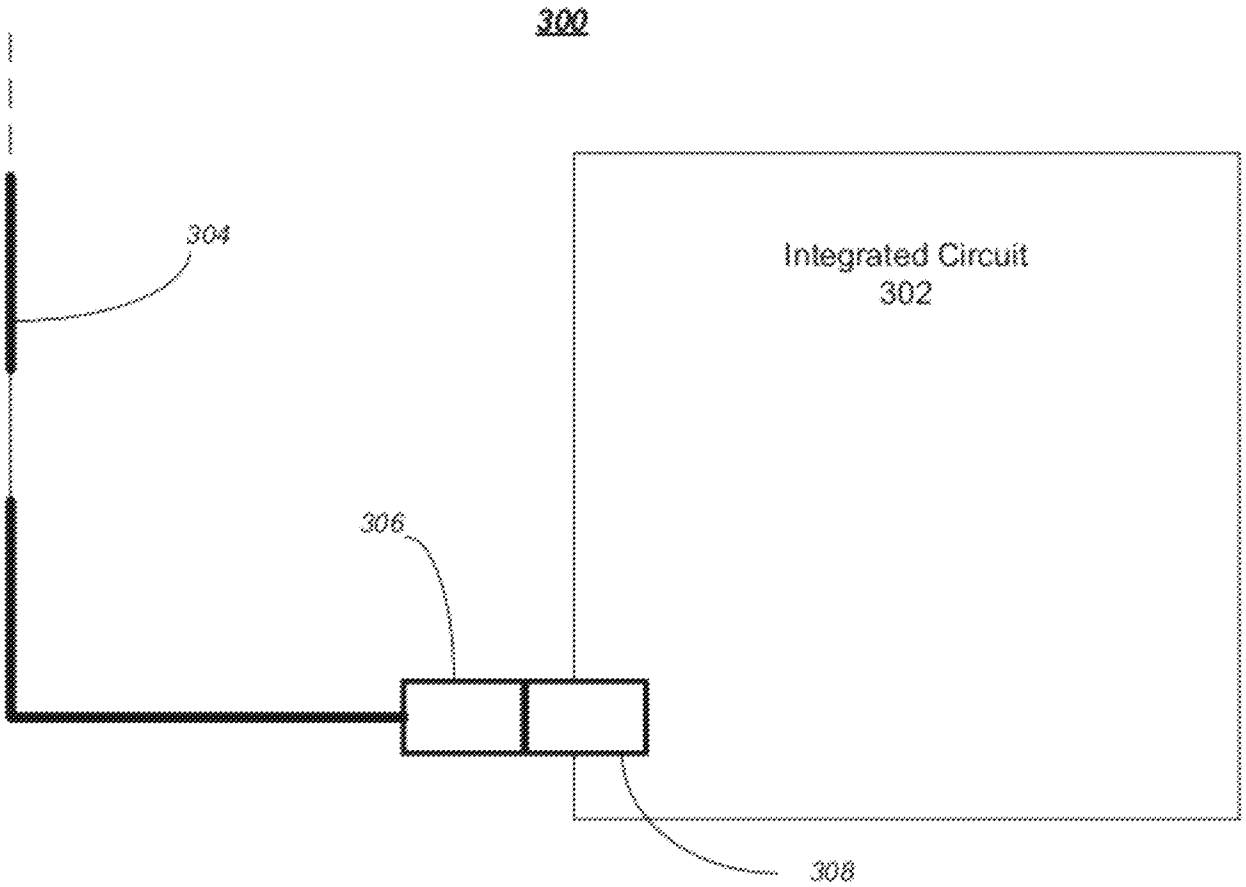
FIG. 3 illustrates one embodiment of a second system.

FIG. 3 illustrates one embodiments of a system 300. System 300 may illustrate, for example, a connection of coaxial cable 304 to an integrated circuit 302. In various embodiments the coaxial cable 304 and integrated circuit 302 may be the same or similar to like components described with reference to FIGS. 1, 2A, 2B and 2C. The embodiments are not limited in this context.

As shown in FIG. 3, coaxial cable 304 may include a connector 306 and integrated circuit 302 may include a connector 308. In various embodiments, the connectors 306 and 308 may comprise matching or mated connectors that are operative to form an electrical connection or coupling between coaxial cable 304 and integrated circuit 302 or one or more radio or transceiver modules of integrated circuit 302. The connectors 306 and 308 may comprise any suitable electrical connector designed to operate at radio frequencies in the multi-megahertz range. In some embodiments, the connectors 306 and 308 may be configured to maintain the shielding that the coaxial design of the coaxial cable 304 offers. In various embodiments, the connectors 306 and 308 may provide a mechanical or other fastening mechanism for connecting matching connectors 306 and 308 using threads, bayonets, braces, push pulls, springs or any other suitable connection means. The embodiments are not limited in this respect.

Figure 4:
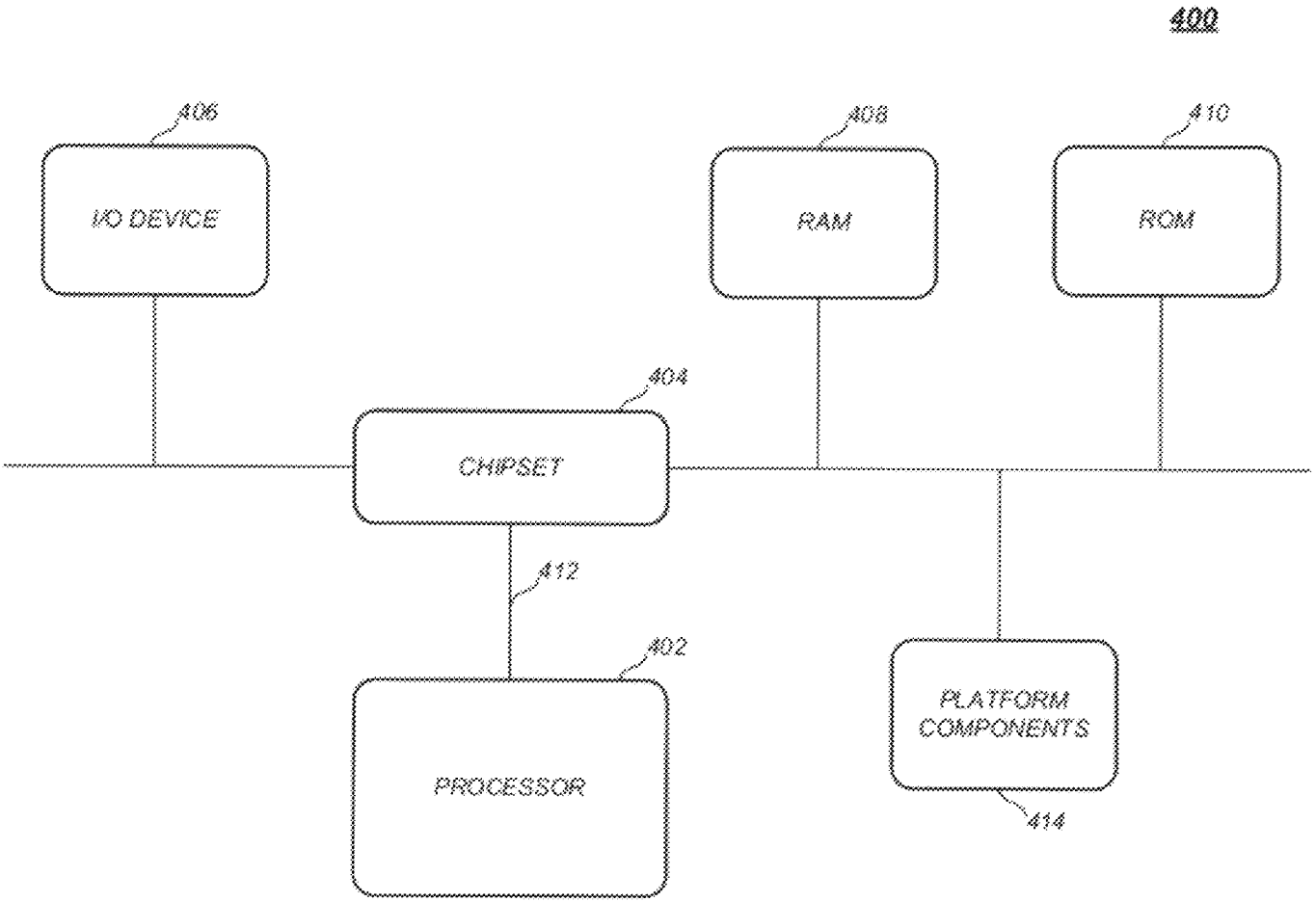
FIG. 4 illustrates one embodiment of a third system.

FIG. 4 is a diagram of an exemplary system embodiment. In particular, FIG. 4 is a diagram showing a system 400, which may include various elements. For instance, FIG. 4 shows that system 400 may include a processor 402, a chipset 404, an input/output (I/O) device 406, a random access memory (RAM) (such as dynamic RAM (DRAM)) 408, and a read only memory (ROM) 410, and various platform components 414 (e.g., a fan, a crossflow blower, a heat sink, DTM system, cooling system, housing, vents, and so forth). These elements may be implemented in hardware, software, firmware, or any combination thereof. The embodiments, however, are not limited to these elements.

As shown in FIG. 4, I/O device 406, RAM 408, and ROM 410 are coupled to processor 402 by way of chipset 404. Chipset 404 may be coupled to processor 402 by a bus 412. Accordingly, bus 412 may include multiple lines.

Processor 402 may be a central processing unit comprising one or more processor cores and may include any number of processors having any number of processor cores. The processor 402 may include any type of processing unit, such as, for example, CPU, multi-processing unit, a reduced instruction set computer (RISC), a processor that have a pipeline, a complex instruction set computer (CISC), digital signal processor (DSP), and so forth.

Although not shown, the system 400 may include various interface circuits, such as an Ethernet interface and/or a Universal Serial Bus (USB) interface, and/or the like. In some exemplary embodiments, the I/O device 406 may comprise one or more input devices connected to interface circuits for entering data and commands into the system 400. For example, the input devices may include a keyboard, mouse, touch screen, track pad, track ball, isopoint, a voice recognition system, and/or the like. Similarly, the I/O device 406 may comprise one or more output devices connected to the interface circuits for outputting information to an operator. For example, the output devices may include one or more displays, printers, speakers, and/or other output devices, if desired. For example, one of the output devices may be a display. The display may be a cathode ray tube (CRTs), liquid crystal displays (LCDs), or any other type of display.

The system 400 may also have a wired or wireless network interface to exchange data with other devices via a connection to a network. The network connection may be any type of network connection, such as an Ethernet connection, digital subscriber line (DSL), telephone line, coaxial cable, etc. The network may be any type of network, such as the Internet, a telephone network, a cable network, a wireless network, a packet-switched network, a circuit-switched network, and/or the like.

Numerous specific details have been set forth herein to provide a thorough understanding of the embodiments. It will be understood by those skilled in the art, however, that the embodiments may be practiced without these specific details. In other instances, well-known operations, components and circuits have not been described in detail so as not to obscure the embodiments. It can be appreciated that the specific structural and functional details disclosed herein may be representative and do not necessarily limit the scope of the embodiments.

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

Some embodiments may be implemented, for example, using a machine-readable or computer-readable medium or article which may store an instruction, a set of instructions or computer executable code that, if executed by a machine or processor, may cause the machine or processor to perform a method and/or operations in accordance with the embodiments. Such a machine may include, for example, any suitable processing platform, computing platform, computing device, processing device, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, volatile or non-volatile memory or media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, encrypted code, and the like, implemented using any suitable high-level, low-level, object-oriented, visual, compiled and/or interpreted programming language.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers or other such information storage, transmission or display devices. The embodiments are not limited in this context.

It should be noted that the methods described herein do not have to be executed in the order described, or in any particular order. Moreover, various activities described with respect to the methods identified herein can be executed in serial or parallel fashion.

Although specific embodiments have been illustrated and described herein, it should be appreciated that any arrangement calculated to achieve the same purpose may be substituted for the specific embodiments shown. This disclosure is intended to cover any and all adaptations or variations of various embodiments. It is to be understood that the above description has been made in an illustrative fashion, and not a restrictive one. Combinations of the above embodiments, and other embodiments not specifically described herein will be apparent to those of skill in the art upon reviewing the above description. Thus, the scope of various embodiments includes any other applications in which the above compositions, structures, and methods are used.

It is emphasized that the Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter that lies in less than all features of a single disclosed embodiment. Thus the following claims are hereby incorporated into the Detailed Description, with each claim standing on its own as a separate preferred embodiment. In the appended claims, the terms "including" and "in which" are used as the plain-English equivalents of the respective terms "comprising" and "wherein," respectively. Moreover, the terms "first," "second," and "third," etc. are used merely as labels, and are not intended to impose numerical requirements on their objects.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. An apparatus, comprising an enclosure;

an integrated circuit enclosed within the enclosure; and a coaxial cable enclosed within the enclosure and arranged to operate as an antenna, a first end of the coaxial cable coupled to the integrated circuit, a second end of the coaxial cable terminating in an open space within the enclosure, the coaxial cable comprising an inner conductor layer and at least one insulator layer, wherein the inner conductor layer comprises solid or stranded conductive metal wire, wherein two or more non-contiguous portions of the inner conductor layer are exposed to allow the exposed inner conductor layer to operate as a radiating element for the antenna, wherein a length of each of the two or more non-contiguous portions of exposed inner conductor layer and a length between each of the two or more non-contiguous portions of exposed inner conductor layer are selected to correspond to a desired resonant frequency for multiband operation of the antenna and to enable the apparatus to send and receive information using both a wireless local area network (WLAN) and a long term evolution (LTE) network.

2. The apparatus of claim 1, the coaxial cable comprising:

the inner conductor layer;

a dielectric insulator layer arranged to surround the inner conductor layer;

an outer conductor layer arranged to surround the inner conductor layer and the dielectric insulator layer; and an outer insulator layer arranged to surround the inner conductor layer, the dielectric insulator layer and the outer conductor layer.

3. The apparatus of claim 2, wherein the dielectric insulator layer and the outer insulator layer are removed in the area of the exposed inner conductor layer allowing radiation from the inner conductor layer to escape.

4. The apparatus of claim 1, wherein the integrated circuit comprises one or more radio modules having a first coaxial connector and the coaxial cable is coupled to the one or more radio modules using a second coaxial connector coupled to the first end of the coaxial cable, the second coaxial connector configured to mate with the first coaxial connector.

5. The apparatus of claim 1, wherein a length of at least one of the two or more non-contiguous portions of exposed inner conductor layer comprises approximately 60 mm corresponding to a frequency of approximately 2400-2485 MHz or approximately 214 mm corresponding to a frequency of approximately 700 MHz.

6. A system, comprising:

a digital display an integrated circuit; and one or more coaxial cables arranged around an outer perimeter of the digital display, each coaxial cable secured within the digital display, each coaxial cable having two or more non-contiguous exposed portions of an inner conductor configured to act as a radiating antenna element, the respective inner conductor of each coaxial cable comprising solid or stranded conductive metal wire, each coaxial cable comprising a first end coupled to the integrated circuit and a second end terminating in an open space within the display, wherein for each of the one or more coaxial cables, a length of each of the two or more non-contiguous exposed portions of the inner conductor and a length between each of the two or more non-contiguous exposed portions of the inner conductor are selected to enable multiband operation of the antenna and to enable the system to send and receive information using both a wireless local area network (WLAN) and a long term evolution (LTE) network.

7. The system of claim 6, each of the one or more coaxial cables comprising the inner conductor;

an inner insulator arranged to surround the inner conductor;

an outer conductor arranged to surround the inner conductor and the inner insulator; and an outer insulator arranged to surround the inner conductor, the inner insulator and the outer conductor.

8. The system of claim 7, wherein one or more portions of the inner and outer insulators are removed to expose a portion of the inner conductor to allow the exposed inner conductor to operate as the radiating antenna element.

9. The system of claim 6, comprising one or more hinges arranged to couple the digital display to a device body containing the integrated circuit, wherein the first end of each coaxial cable is coupled to the integrated circuit using coaxial connectors on the first end of that coaxial cable and the integrated circuit, and wherein each coaxial cable is arranged to pass through at least one of the one or more hinges into a cavity created by the perimeter edges of the digital display.

10. A coaxial cable antenna, comprising:

an inner conductor comprising solid or stranded conductive metal wire;

an inner insulator arranged to surround the inner conductor;

an outer conductor arranged to surround the inner conductor and the inner insulator;

an outer insulator arranged to surround the inner conductor, the inner insulator and the outer conductor; and a coaxial connector on a first end of the coaxial cable antenna, the coaxial connector configured to mate with a second coaxial connector to form an electrical connection with an integrated circuit, the coaxial cable antenna and the integrated circuit to be secured within a same enclosure, a second end of the coaxial cable antenna to terminate in an open space within the enclosure;

wherein two or more portions of the inner and outer insulators are removed to expose two or more non-contiguous portions of the inner conductor to allow the exposed inner conductor to operate as a radiating antenna element, wherein a length of each of the two or more non-contiguous portions of exposed inner conductor and a length between each of the two or more non-contiguous portions of exposed inner conductor are selected to enable the coaxial cable antenna to operate as a multiband antenna for sending and receiving information using both a wireless local area network (WLAN) and a long term evolution (LTE) network.

11. The coaxial cable antenna of claim 10, wherein the inner insulator comprises one or more of a plastic, foam, polyethylene or Teflon insulator material, the outer conductor comprises one or more layers of dielectric material and the outer insulator comprises one or more solid insulating materials.

* * * * *